US005715776A

United States Patent [19]

Seidl

[11] Patent Number: 5,715,776

[45] Date of Patent: Feb. 10, 1998

[54] COOLING SYSTEM FOR AN INTERNAL COMBUSTION ENGINE

[75] Inventor: Jiri Seidl, München, Germany

[73] Assignee: Daewoo Motor Co., Ltd., Incheon, Rep. of Korea

[21] Appl. No.: 619,570

[22] PCT Filed: Jul. 26, 1994

[86] PCT No.: PCT/KR94/00099

§ 371 Date: Aug. 26, 1996

§ 102(e) Date: Aug. 26, 1996

[87] PCT Pub. No.: WO96/03574

PCT Pub. Date: Feb. 8, 1996

[51] Int. Cl.[6] ..... F01P 7/14

[52] U.S. Cl. ..... 123/41.1; 123/41.44; 123/198 C

[58] Field of Search ..... 123/41.1, 41.44, 123/41.47, 41.74, 198 C

[56] References Cited

U.S. PATENT DOCUMENTS 4,662,320 5/1987 Moriya ..... 123/41.44

FOREIGN PATENT DOCUMENTS 901462 3/1954 Germany .
807673 1/1959 United Kingdom .
2160588 12/1985 United Kingdom .

*Primary Examiner*—Noah P. Kamen
*Attorney, Agent, or Firm*—Lowe, Price, LeBlanc & Becker

[57] ABSTRACT

A cooling system of an internal combustion engine wherein a water pump (1), a thermostat (2), a water pump exit port (3), a water jacket entrance passage (4), an exit passage (5), a bypass passage (6) and a bypass opening (7) are located in the rear (transmission side) of a cylinder head (8) of the engine. A water pump and thermostat body (13) is attached to the rear face of the cylinder head (8). The bypass passage (6) together with the exit passage (5) are cast by using a metal mold drag. The coolant flow path forms a U-path starting with the coolant from the water pump (1) in the rear of the cylinder head (8) to the front of the cylinder head (8), then down to the front of the cylinder block (10), then to the rear of the cylinder block (10), then up to the rear of the cylinder head (8).

2 Claims, 4 Drawing Sheets

COOLING SYSTEM FOR AN INTERNAL COMBUSTION ENGINE

BACKGROUND OF THE INVENTION

1. Field of the Invention

The present invention relates to a cooling system of an internal combustion engine, and more particularly to an improved arrangement of a water pump and a thermostat of the cooling system.

2. Description of the Prior Art

A water cooling system for an internal combustion engine cools the engine by circulating water into the water jackets provided in the cylinder head and cylinder block of the engine. The system is comprised of a radiator, a water pump, a cooling fan, and a thermostat as the main parts.

SAE Technical Paper Series No. 920671 discloses a cooling system in which a water pump is located at the rear end of the cylinder block and driven by a left bank intake cam. This system reduces the complexity of external plumbing and simplifies the packaging of the accessories. A thermostat is located directly in front of the water pump. The flow path pattern of this cooling system shows that most coolant moves from the rear of the block to the front, up to the cylinder head, and finally to the back of the head.

Because of the complicated design of this conventional system, the coolant flow path has higher frictional losses contributing to a longer warm-up period.

In German Patent No. 2706954 granted to Audi NSU Auto Union AG, a water pump and a thermostat are arranged at the side of a cylinder block in a housing combined with a coolant casing. A lateral opening for inserting the thermostat forms the hosing. However, this arrangement causes a long warm period and requires a sand core for a water pump chamber.

Furthermore, a cooling system in the SAE Technical Paper Series No. 920673 discloses a reverse flow cooling system starting with water from a water pump entering the engine block and immediately flowing to the cylinder head. The major portion of the coolant still flowing through the cylinder head enters the cylinder block. This reverse flow cooling system is, however, complicated and also results in a long warm-up period.

Finally, MTZ Motortechnische Zeitschrift 51 (1990) 11 states another cooling system in which a coolant exit port and a thermostat are located at the rear end of the cylinder head, and a water pump is located in the area of the longitudinal member.

The cooling system in MTZ is disadvantageous because the distance between the water pump and thermostat is long, contributing to a negative effect due to the overall length of the engine and difficult flow control.

SUMMARY OF THE INVENTION

An object of the present invention is to provide a cooling system for an internal combustion engine which is capable of reducing the overall length of a transversely mounted engine.

Another object of the invention is to provide a cooling system for an internal combustion engine which is capable of reducing the frictional losses during the engine warm-up period and shortening the warm-up period.

A further object of the invention is to provide a cooling system for an internal combustion engine which is capable of reducing the manufacturing costs by using a mold drag for the bypass and exit passages.

A still further object of the invention is to provide a cooling system for an internal combustion engine which is capable of providing improved accessibility to the water pump and thermostat.

To achieve these objects, a cooling system according to the present invention is comprised of a cylinder block having one or more cylinders and a water jacket therein; a cylinder head fixed by multiple connecting means to the cylinder block with a gasket therebetween and having a water jacket therein; a water pump attached to one side of the cylinder head, the water pump being driven by a cam shaft mounted on the cylinder head and circulating coolant through the cooling system; and a thermostat disposed at the downstream of the coolant toward the cylinder head from the cylinder block for selecting a flow of the coolant to either a radiator or the water pump in accordance with a temperature of the circulating coolant: wherein a flow path of the circulating coolant forms a pattern from the water pump toward an opposite distant portion of the cylinder head to the water pump, down to a corresponding portion of the cylinder block, to a portion of the cylinder block adjacent to the water pump, up to a corresponding portion of the cylinder head, to the thermostat, and either directly to the water pump when above a predetermined temperature of the engine or to the radiator and then to the water pump when below the predetermined temperature of the engine.

Further, the thermostat is attached to the cylinder head with the longitudinal axis of the thermostat being parallel to the rotational axis of the water pump.

BRIEF DESCRIPTION OF THE DRAWINGS

The above objects and other advantages of the present invention will be more clarified by describing a preferred embodiment thereof with reference to the accompanying drawings in which.

DESCRIPTION OF THE PREFERRED EMBODIMENT

Figure 1:
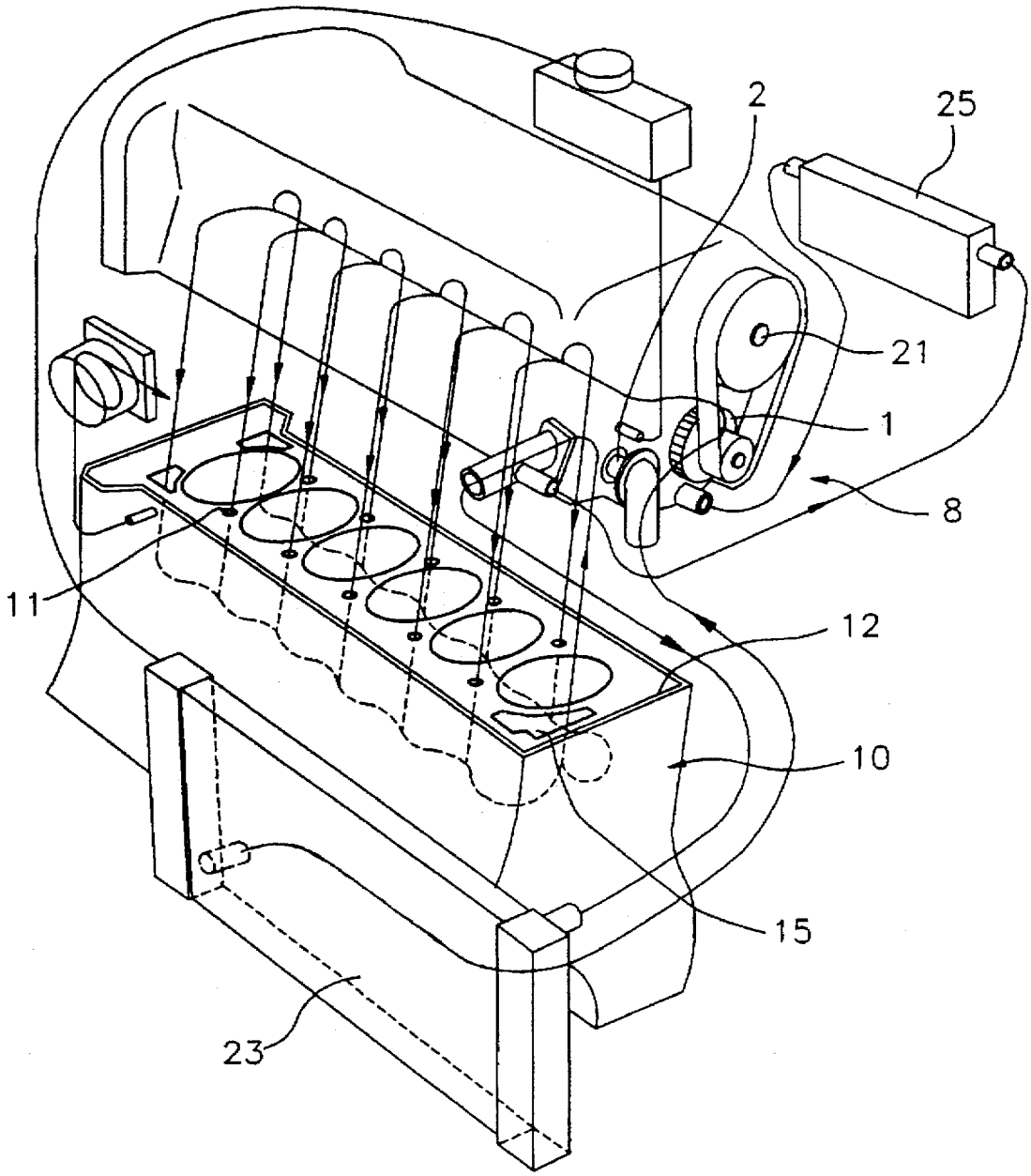
FIG. 1 is a schematic perspective view showing a cooling system with the coolant flow path, in accordance with the present invention.
Figure 2:
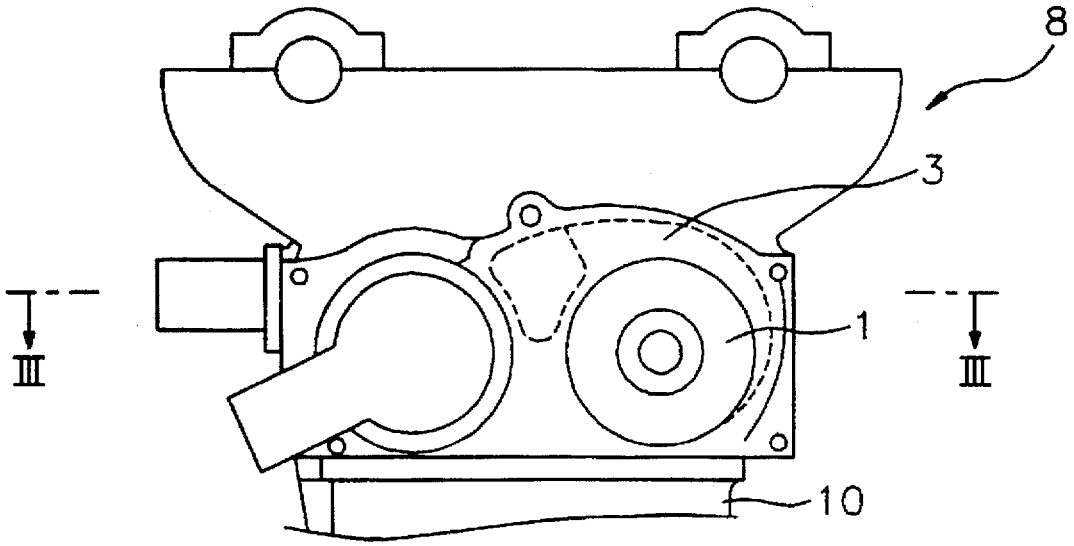
FIG. 2 is a rear view of a cylinder head with a water pump installed thereto, showing a part of a cylinder block.

Referring to FIGS. 1 through 3A, a water pump 1 together with a flow control means comprising a thermostat 2, a water pump exit port 3, a water jacket entering passage 4, an exit passage 5, a bypass passage 6 and a bypass opening 7 are located at the left side of a cylinder head 8 of the engine with respect to the vehicle forward direction. A camshaft 21 belt-drives the water pump 1.

Figure 3:
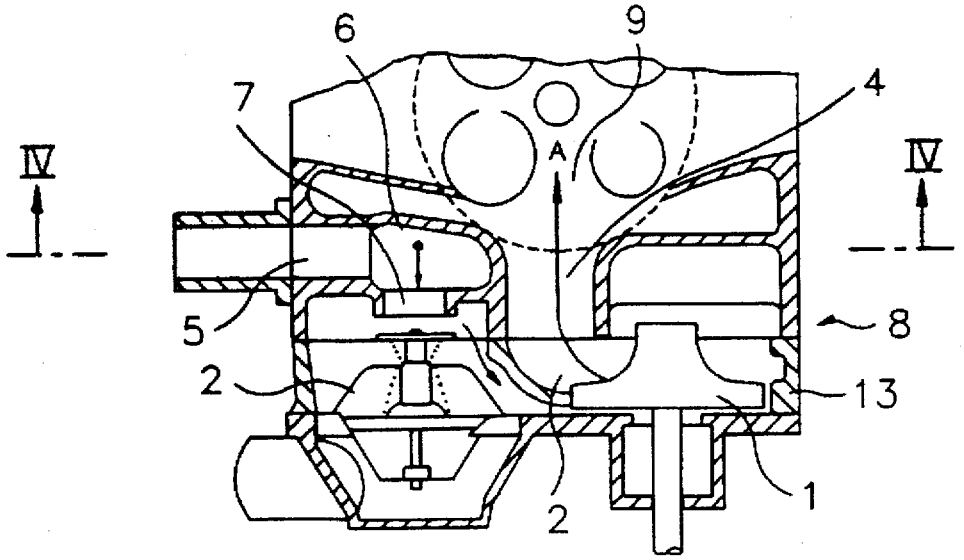
FIG. 3 is a cross-sectional view of the rear part of the cylinder head, taken along line III—III of FIG. 2 showing the coolant flow when the thermostat is closed.

A water pump 1 and thermostat body 13 are detachably attached to the left face of the cylinder head 8 to dispose the water pump 1 and thermostat 2 at the left side of the cylinder head 8. As shown in FIG. 3, the water pump exit port 3 is provided downstream of the coolant flow discharged from the water pump 1. The water jacket entrance passage 4 is defined in the left end of the cylinder head 8 and is directly connected with the water pump exit port 3 to communicate with each other.

Figure 3A:
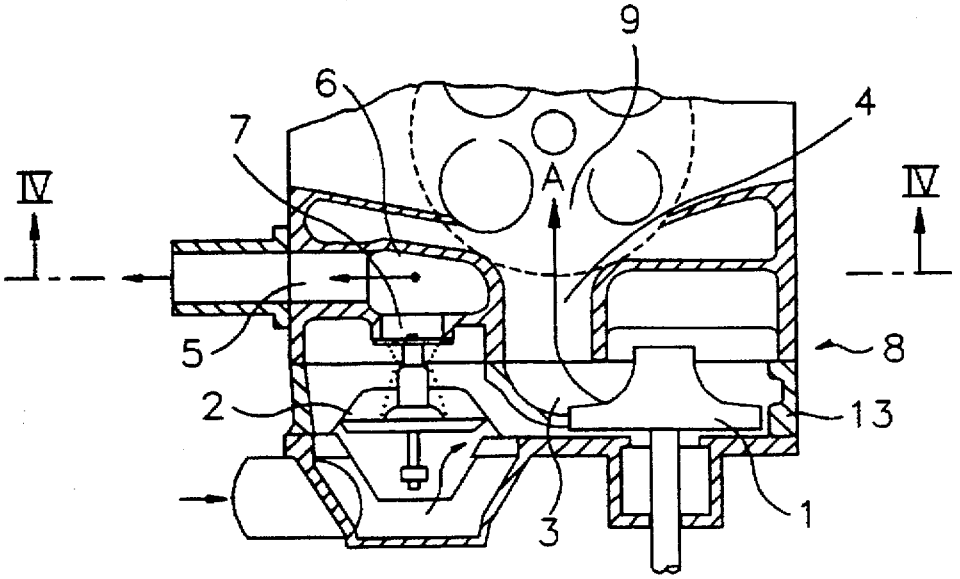
FIG. 3A is a cross-sectional view of the rear part of the cylinder head, taken along line III—III of FIG. 2 showing the coolant flow when the thermostat is opened.
Figure 4:
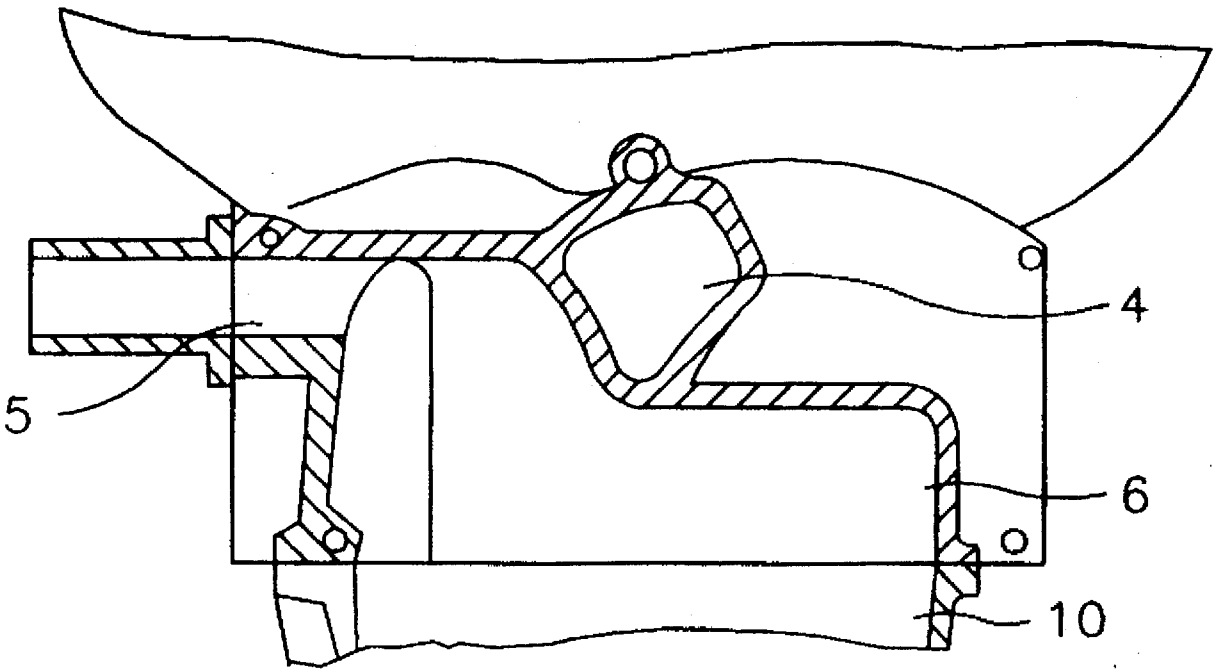
FIG. 4 is a longitudinal-sectional view of the cylinder head and cylinder block, taken along line IV—IV of FIG. 3.

In the thermostat 2, the longitudinal axis of the thermostat is located parallel to the rotational axis of the water pump 1 at the left end of the cylinder head 8. The inlet of the thermostat 2 communicates with the bypass passage 6 through the bypass opening 7 and with the exit passage 5 in the cylinder head 8, as shown in FIGS. 3 and 3A.

In FIG. 1, a cylinder head gasket 12 is provided with a plurality of differently-sized openings 11 to allow the stream of the coolant to flow into the cylinder block 10.

According to the embodiment of the present invention, the bypass passage 6 is cast by using a metal mold drag. Also, the exit passage 5 may be cast by using a metal mold drag together with the bypass passage 6.

Hereafter, a description of the coolant flow path of the cooling system of this invention will be given, with reference to FIGS. 1, 3, and 3A.

The coolant flows, as shown by the direction of arrow A in FIGS. 3 and 3A, from the water pump 1 directly to the water jacket 9 in the cylinder head 8 through water jacket entrance passage 4, cooling first the hot combustion chambers, exhaust ports, and exhaust valve bridges (not shown). The coolant flows through the cylinder head 8 in the longitudinal direction before entering the cylinder block 10. Then the coolant enters the cylinder block 10 through the openings 11 in the cylinder head gasket 12, cooling critical regions between cylinder bores.

During the warm-up period the coolant transports the heat from the hot cylinder head 8 to the cold cylinder block 10, warming up the oil and the cylinder bores. The higher oil temperature in the main oil duct and in the liners reduces the frictional losses and shortens the warm-up phase. The coolant flows back to the left side of the cylinder block 10 and exits the cylinder block 10 through an outlet 15 in the cylinder head gasket 12 to flow into the exit passage 5 and bypass passage 6 in the left side of the cylinder head 8 as shown in FIG. 3A. From the exit passage 5 the coolant, with the thermostat 2 opened, flows into either the radiator 23 or the heating system 25.

When the engine is cold and the thermostat 2 is closed as shown in FIG. 3, the coolant returns directly to the water pump 1 through the bypass passage 6 and a return passage (not shown).

Thus, a pattern is formed by the coolant starting to flow from the water pump 1 at the left of the cylinder head 8 to the right of the cylinder head 8, down to the right of the cylinder block 10, to the left of the block 10, and up to the left side of the cylinder head 8 to complete a U-path.

I claim:

1. A cooling system of an internal combustion engine comprising:

a cylinder block having one or more cylinders and a water jacket therein;

a cylinder head fixed by multiple connecting means to the cylinder block with a gasket therebetween and having a water jacket therein;

a water pump attached to one side of the cylinder head, the water pump being driven by a cam shaft mounted on the cylinder head and circulating coolant through the cooling system; and a thermostat disposed at the downstream of the coolant toward the cylinder head from the cylinder block for selecting a flow of the coolant to either a radiator or the water pump in accordance with a temperature of the circulating coolant;

wherein a flow path of the circulating coolant forms a pattern from the water pump toward an opposite distant portion of the cylinder head to the water pump, down to a corresponding portion of the cylinder block, to a portion of the cylinder block adjacent to the water pump, up to a corresponding portion of the cylinder head, to the thermostat, and directly to the water pump when below a predetermined temperature of the engine, and to the radiator and then to the water pump when above the predetermined temperature of the engine.

2. A cooling system of an internal combustion engine according to claim 1, wherein the thermostat is attached to the cylinder head with the longitudinal axis of the thermostat being parallel to the rotational axis of the water pump.

* * * * *